US007672607B2

(12) United States Patent
Yoshikawa

(10) Patent No.: US 7,672,607 B2
(45) Date of Patent: Mar. 2, 2010

(54) FIXING DEVICE TO REDUCE WARM-UP TIME AND APPARATUS USING SAME

(75) Inventor: Takahiro Yoshikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 544 days.

(21) Appl. No.: 11/175,291

(22) Filed: Jul. 7, 2005

(65) Prior Publication Data

US 2006/0013607 A1 Jan. 19, 2006

(30) Foreign Application Priority Data

Jul. 13, 2004 (JP) ..... 2004-205591

(51) Int. Cl.
*G03G 15/20* (2006.01)

(52) U.S. Cl. ..... 399/70

(58) Field of Classification Search ..... 399/43, 399/69, 70, 329; 219/216
See application file for complete search history.

(56) References Cited

U.S. PATENT DOCUMENTS

| | | | | |
|---|---|---|---|---|
| 5,402,211 | A | 3/1995 | Yoshikawa | |
| 5,714,736 | A * | 2/1998 | Yoneda et al. | 219/216 |
| 5,850,588 | A | 12/1998 | Yoshikawa | |
| 5,899,599 | A * | 5/1999 | Kato | 399/69 |
| 6,160,974 | A | 12/2000 | Yoshikawa et al. | |
| 6,351,619 | B1 * | 2/2002 | Yamada | 399/70 |
| 6,496,666 | B2 * | 12/2002 | Hayashi et al. | 399/69 |
| 6,501,914 | B2 | 12/2002 | Yoshikawa | |
| 6,535,701 | B2 * | 3/2003 | Baba | 399/69 |
| 6,567,624 | B1 * | 5/2003 | Murata | 399/69 |
| 6,594,464 | B2 * | 7/2003 | Hayashi et al. | 399/325 |
| 6,757,502 | B2 | 6/2004 | Yoshikawa | |
| 6,807,386 | B2 * | 10/2004 | Yasui et al. | 399/69 |
| 6,823,149 | B2 | 11/2004 | Yoshikawa et al. | |
| 6,882,808 | B2 * | 4/2005 | Ota | 399/69 |
| 2003/0231893 | A1 | 12/2003 | Yoshikawa | |
| 2004/0109709 | A1 | 6/2004 | Ishibashi et al. | |
| 2004/0264991 | A1 | 12/2004 | Yoshikawa | |

FOREIGN PATENT DOCUMENTS

| | | | |
|---|---|---|---|
| JP | 09197862 | A * | 7/1997 |
| JP | 11095582 | A * | 4/1999 |
| JP | 2001-228747 | | 8/2001 |
| JP | 2002287543 | A * | 10/2002 |
| JP | 2003-307963 | | 10/2003 |
| JP | 2003307963 | A * | 10/2003 |

(Continued)

OTHER PUBLICATIONS

U.S. Appl. No. 11/754,817, filed May 29, 2007, Yoshikawa.

(Continued)

*Primary Examiner*—Robert Beatty
(74) *Attorney, Agent, or Firm*—Oblon, Spivak, McClelland, Maier & Neustadt, L.L.P.

(57) ABSTRACT

A fixing device, including a fixing rotary body including a first heat source, a pressing rotary body including a second heat source, and a control device configured to cause, at a time of warm-up of the fixing device, the fixing rotary body to rotate while causing at least one of the first heat source and the second heat source to generate heat, and to allow, after a surface temperature of the fixing rotary body has risen to a preselected warm-up temperature, a sheet pass or a printing to be executed and cause, if a sheet pass is not executed, the fixing rotary body to rotate for a preselected period of time.

14 Claims, 9 Drawing Sheets

FOREIGN PATENT DOCUMENTS

JP 2003330317 A * 11/2003

OTHER PUBLICATIONS

U.S. Appl. No. 11/020,205, filed Dec. 27, 2004, Masahiko Satoh, et al.

U.S. Appl. No. 11/521,506, filed Sep. 15, 2006, Yoshikawa.

U.S. Appl. No. 11/928,454, filed Oct. 30, 2007, Yoshikawa.

U.S. Appl. No. 11/830,457, filed Jul. 30, 2007, Yoshikawa.

U.S. Appl. No. 12/184,710, filed Aug. 1, 2008, Yoshikawa.

* cited by examiner

FIXING DEVICE TO REDUCE WARM-UP TIME AND APPARATUS USING SAME

BACKGROUND OF THE INVENTION

1. Field of the Invention

The present invention relates to an electrophotographic copier, printer, facsimile apparatus or similar image forming apparatus and more particularly to a fixing device for use in an image forming apparatus and including a fixing roller, a press roller, a heat roller having a heat source thereinside and a fixing belt passed over the fixing roller and press roller.

2. Description of the Background Art

A fixing device applicable to an image forming apparatus is disclosed in, e.g., Japanese Patent Application No. 2003-307963. The fixing device taught in this document is configured to achieve various purposes including reducing a warm-up time to a stand-by state and a buildup time from the stand-by state, speeding up fixation, stabilizing the output of a power supply, and reducing power consumption. The document proposes an image forming apparatus using such a fixing device also. A controller included in the fixing device controls the turn-on and turn-off of the individual heater connected to a power supply. More specifically, at the time of warm-up, buildup and printing, the controller turns on only the heater of the heat roller to thereby apply a sufficient amount of heat to the fixing belt, which is turning, via said heat roller. Further, in a stand-by state, the controller turns on the heaters of the heat roller and press roller in order to maintain the temperature of the heat roller and press roller. In this manner, the controller of the above fixing device turns on or turns off each heater at a particular timing.

Generally, in a conventional fixing device, a fixing roller and a press roller rotatable in pressing contact therewith each are provided with a surface layer formed of rubber, but a heat roller, accommodating a heater therein, is not provided with such a surface layer in order to have a small thermal capacity. While sharp thermal response is achievable if the heat roller is provided with a small thermal capacity small and if the heater of the heat roller is caused to generate a great amount of heat in a continuous sheet-pass mode, this scheme is unable to reduce power consumption. To reduce the power consumption of the fixing device and therefore the total power consumption of an entire image forming apparatus, the amount of heat to be generated by each of the heaters of the fixing roller and press roller is made smaller than the amount of heat to be generated by the heater of the heat roller.

However, the problem with the conventional fixing device stated above is that the heat roller, having a smaller thermal capacity than the fixing roller and press roller, is greatly effected by the temperatures of the fixing roller and press roller via the fixing belt at the beginning of a sheet-pass after the stand-by mode. More specifically, if the temperature of the fixing roller or that of the press roller is lowered in, e.g., the stand-by mode in which the fixing belt remains in a halt, the temperature of the fixing belt is low at the beginning of a sheet pass and therefore degrades fixation.

In light of the above, it is necessary to maintain the temperatures of the fixing roller and press roller above a preselected temperature in the stand-by mode. However, although the fixing roller and press roller both receive heat from the fixing belt via their surface layers at the time of start-up of the fixing device because the belt is turned, the temperatures of the fixing roller and press roller are lowered after the stop of movement of the belt partly because the amount of heat output from the heater is small and partly because the fixing roller and press roller each have a great thermal capacity.

SUMMARY OF THE INVENTION

It is an object of the present invention to provide a fixing device capable of reducing a warm-up time and preventing the temperature of a fixing belt from being lowered at the beginning of a sheet path just after warm-up, and an image forming apparatus using the same.

A fixing device of the present invention includes a fixing rotary body including a first heat source, a pressing rotary body including a second heat source, and a controller. The controller causes, at the time of warm-up of the fixing device, the fixing rotary body to rotate while causing at least one of the first and second heat sources to generate heat and allows, after the surface temperature of the fixing rotary body has risen to a preselected warm-up temperature, a paper pass or a printing to be executed or causes, if a sheet pass is not executed, the above one heat source to stop generating heat and then causes the fixing rotary body to rotate for a preselected period of time.

Further, a fixing device of the present invention includes a fixing roller, a press roller, a heat roller including a heat source, a fixing belt passed over the fixing roller and heat roller, and a controller. At least one of the fixing roller and press roller includes a heat source. The controller causes, at the time of warm-up of the fixing device, the fixing belt to turn while causing at least one of heat sources included in rollers to generate heat and allows, after the surface temperature of the fixing belt has risen to a preselected warm-up temperature, a paper pass or a printing to be executed or causes, if a sheet pass is not executed, the above one heat source to stop generating heat and then causes the fixing belt to turn for a preselected period of time.

An image forming apparatus, including either one of the fixing devices stated above, is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
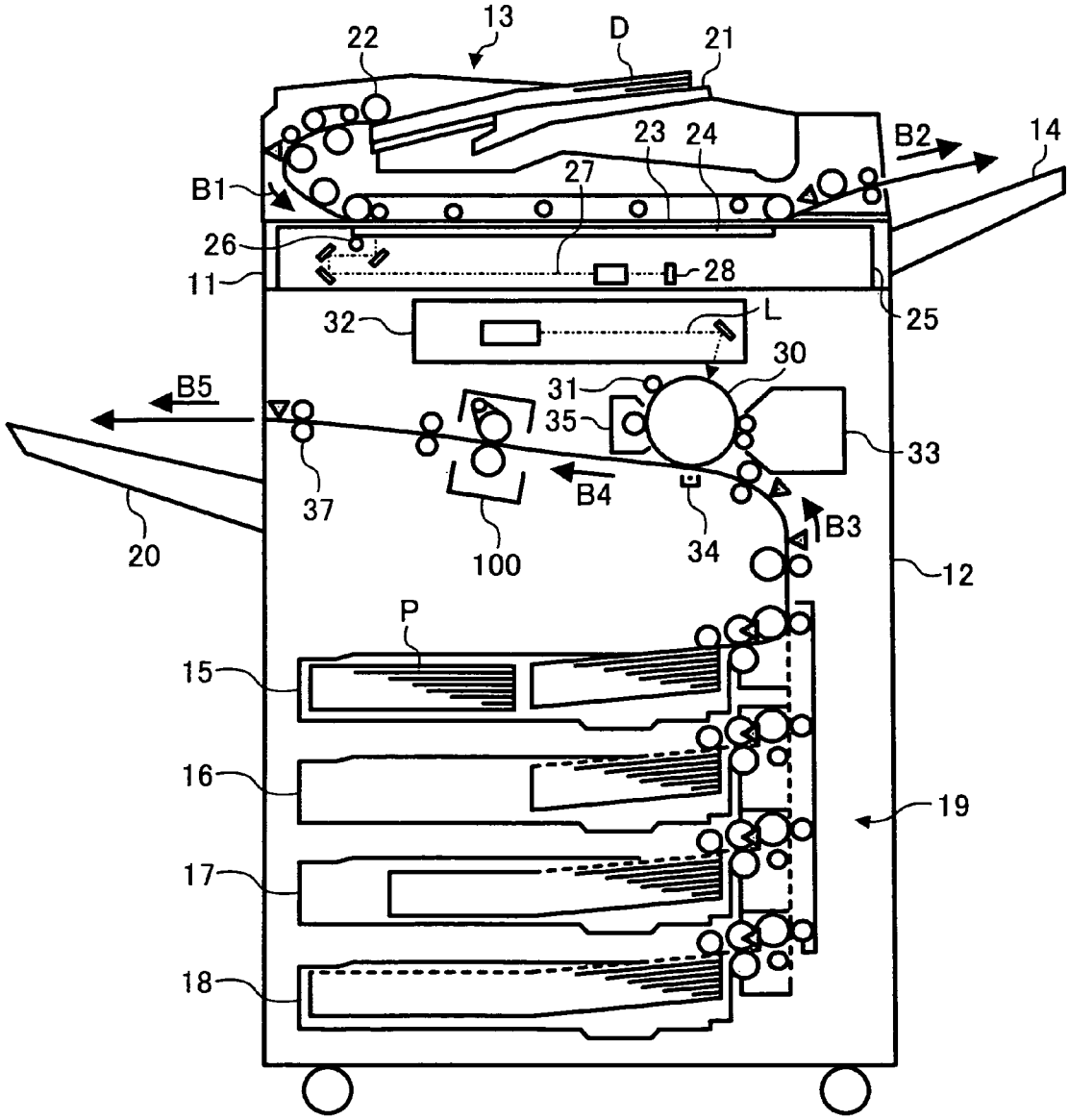
FIG. 1 is a view showing an image forming apparatus embodying the present invention.

Referring to FIG. 1 of the drawings, an image forming apparatus embodying the present invention is shown and may be implemented as, e.g., an electrophotographic copier or a printer by way of example. As shown, the image forming apparatus is generally made up of an document scanning unit 11 for reading documents, a printer or image forming section 12 for forming images, an ADF (Automatic Document Feeder) 13, a document stack tray for stacking documents sequentially driven out of the ADF 13, a sheet feeding section 19 including sheet cassettes 15 through 18, and a sheet stack tray 20 for stacking paper sheets or similar recording medium driven out of the printer 12.

In operation, the operator of the image forming apparatus stacks desired documents D on a tray 21 included in the ADF 13 and then presses a print start key or otherwise manipulates an operating section not shown. In response, the top document D is paid out by a pickup roller 22 in a direction indicated by an arrow B3 in FIG. 1 and then conveyed by a belt 23 in rotation to a glass platen 24, which is fixed on the top of the image scanner 11. When the document D is brought to a stop on the glass platen 24, an image scanner 25, positioned between the printer 12 and the glass platen 24 reads the image of the document D. More specifically, the image scanner 25 includes a light source 26 for illuminating the document D positioned on the glass platen 24, and optics 27 for focusing a document image on a CCD (Charge Coupled Device) image sensor or similar image sensor, or photoelectric converter, 28.

After the document D has been fully scanned by the image scanner 25, it is again conveyed by the belt 23 to the document stack tray 14 in a direction indicated by an arrow B2 in FIG. 1. In this manner, the documents D are sequentially fed to the glass platen 24 one by one and read by the document scanning unit 11 in which the document scanner 25 is arranged.

The printer 12 includes a photoconductive drum 30, which is a specific form of an image carrier. The photoconductive drum (simply drum hereinafter) 30 is rotated clockwise, as viewed in FIG. 1, while having its surface uniformly charged to a preselected potential by a charger 31. An optical writing unit 32, positioned in the upper portion of the printer 12, emits a laser beam L modified in accordance with image data read by the image scanning unit 11. The laser beam L scans the charged surface of the drum 30 imagewise to thereby form a latent image on the drum 30. A developing unit 33 develops the latent image with toner when the latent image is conveyed thereby by the drum 20 in rotation, thereby forming a corresponding toner image. An image transferring unit 34, facing the drum 30, transfers the toner image thus formed on the drum 20 to a paper sheet or similar recording medium P fed from the sheet feeding section 19 in the direction B3. A drum cleaner 35 removes toner left on the drum 30 after the image transfer.

More specifically, the sheet feeding section 19, positioned in the lower portion of the printer 12, includes a plurality of (four in the illustrative embodiment) sheet cassettes 15, 16, 17 and 18 each being loaded with a stack of paper sheets P. A sheet P stacked on the top of any one of the sheet cassettes 15 through 18 is paid out in the direction B3, so that the toner image is transferred from the drum 30 to the paper sheet P. The paper sheet P, carrying the toner image thereon, is conveyed to a fixing device 100, which is also disposed in the printer 12, in a direction indicated by an arrow B4 in FIG. 1. The fixing device 100 fixes the toner image on the paper sheet P with heat and pressure, as will be described specifically hereinafter. Subsequently, the paper sheet P is driven out of the printer 12 to the sheet stack tray 20 via an outlet roller pair 37.

Figure 2:
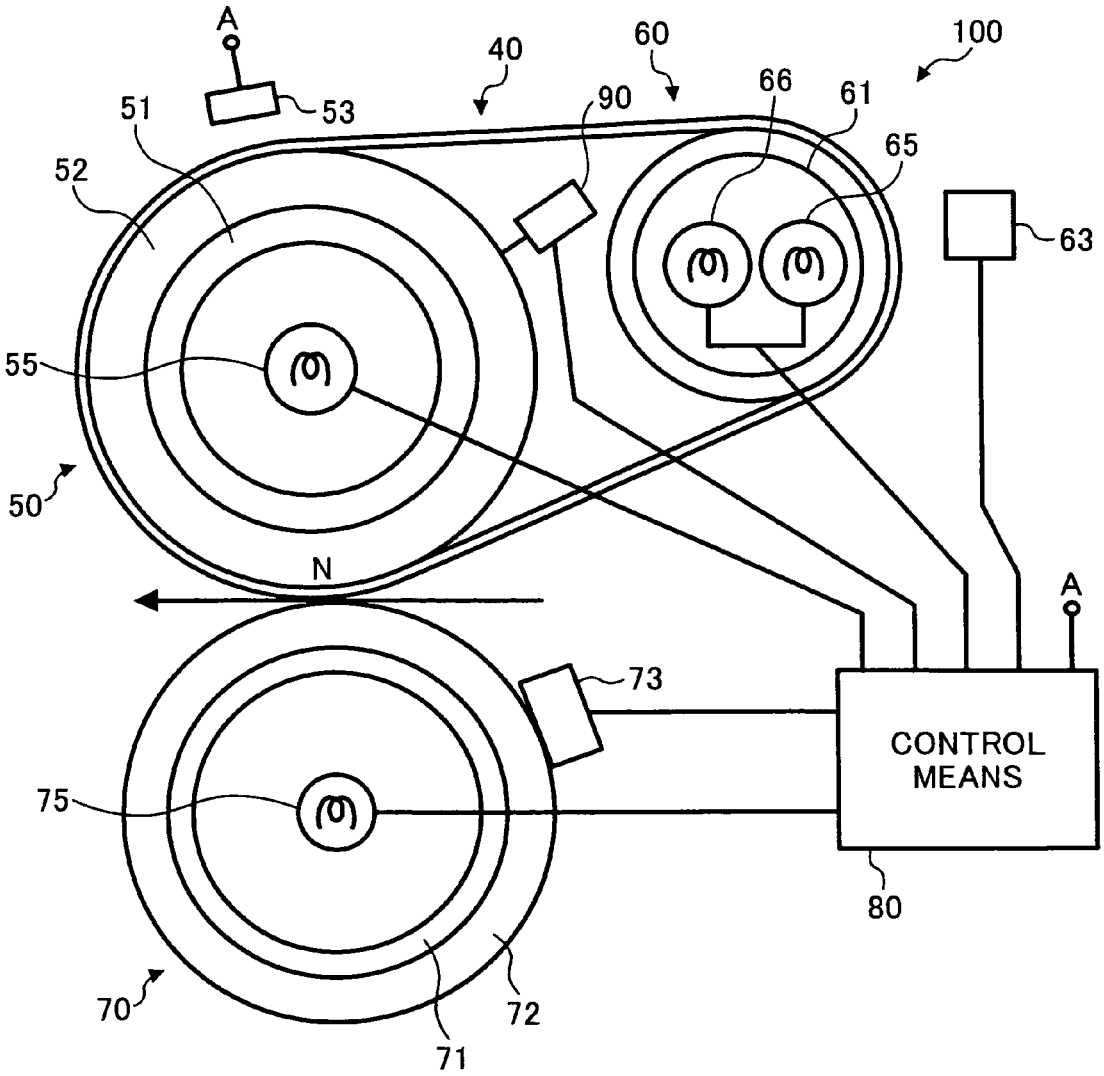
FIG. 2 is a fragmentary view showing a fixing device included in the illustrative embodiment.

Reference will be made to FIG. 2 for describing the configuration of the fixing device 100 unique to the illustrative embodiment. As shown, the fixing device 100 includes a fixing roller or fixing member 50, a heat roller 60, a press roller 70 and a fixing belt 40 passed over the fixing roller 50 and heat roller 60.

The fixing roller 50 is caused to rotate by a motor 90 to, in turn, drive the heat roller 60 and press roller 70 via the fixing belt 40. Temperature sensors 53, 63 and 73 adjoin the fixing roller 50, heat roller 60 and press roller 70, respectively, each for sensing the surface temperature of the associated roller. Further, heat sources 55, 65 and 66 and 75 are disposed in the fixing roller 50, heat roller 60 and press roller 70, respectively. A controller or control means 80 controls the motor 90 and heat sources 55, 65 and 66 and 75 in accordance with the outputs of the temperature sensors 53, 63 and 73.

The fixing roller 50 is made up of a metallic core 51 and a cover layer 52 covering the core 51. In the illustrative embodiment, the heat source or heater 55 is disposed in the core 51. The cover layer 52 is formed of rubber or similar elastic material on which a fluorocarbon resin layer is formed. Likewise, the heat roller 60 includes a metallic core 61 in which the heat sources or heaters 65 and 66 are disposed. The fixing belt 40 passed over the fixing roller 50 and heat roller 60 is implemented by an Ni, SUS steel or similar metallic film or a Pl, PAl or similar resin layer and a fluorocarbon resin layer formed on the surface thereof.

The press roller 70 is rotatable while being pressed against the fixing roller 50 via the fixing belt 40. The press roller 70, like the fixing roller 50, is made up of a metallic core 71 and a cover layer 72 covering the core 71. In the illustrative embodiment, the heat source or heater 75 is disposed in the metallic core 71. The cover layer 72 is formed of rubber or similar elastic material on which a fluorocarbon resin layer is formed.

In the illustrative embodiment, the controller 80 selectively turns on or turns off the heaters 55, 65 and 66 and 75 of the fixing roller 50, heat roller 60 and press roller 70, respectively, in accordance with temperatures sensed by the temperature sensors 53, 63 and 73 and the drive timing of the image forming apparatus. The paper sheet P, not shown, is conveyed via a nip N between the cover layers 52 and 72 of the fixing roller 50 and press roller 70, respectively, which are pressed against each other. As a result, the toner image carried on the paper sheet P is fixed by the heat and pressure of the fixing roller 50 and fixing belt 40. While the fixing roller 50 and press roller 70 both are provided with a heater in the illustrative embodiment, only one of them may be provided with a heater, if desired.

In the illustrative embodiment, the total amount of heat generated by the heaters 65 and 66 of the heat roller 60 is selected to be greater than the amount of heat generated by the heater 55 of the fixing roller 50 or the heater 75 of the press roller 70. This is because the cover layers 52 and 72, respectively included in the fixing roller 50 and press roller 70, are low in thermal conductivity and therefore obstruct the rapid warm-up of the rollers 50 and 70 after the start-up of the image forming apparatus. To rapidly warm-up the fixing belt 40 at the time of start-up in such conditions, it is desirable to rotate the heat roller 60 not coated with silicone rubber.

If the fixing belt 40, heated to a preselected temperature after the start-up of the apparatus, is caused to stop turning, then the temperature of the fixing roller 50 and that of the press roller 70 drop because the rollers 50 and 70 are not fully warmed up to the inside then. Therefore, if the fixing belt 40 is again driven to convey a paper sheet in the above condition, then the heat of the belt 40 is rapidly absorbed by the fixing roller 50 and press roller 70. It is therefore likely that heat output from the heat roller 60 is too short to maintain a fixable temperature. As a result, the heaters 55 and 75 of the fixing roller 50 and press roller 70, respectively, each are required to generate a greater amount of heat at the time of start-up of the apparatus.

Figure 3:
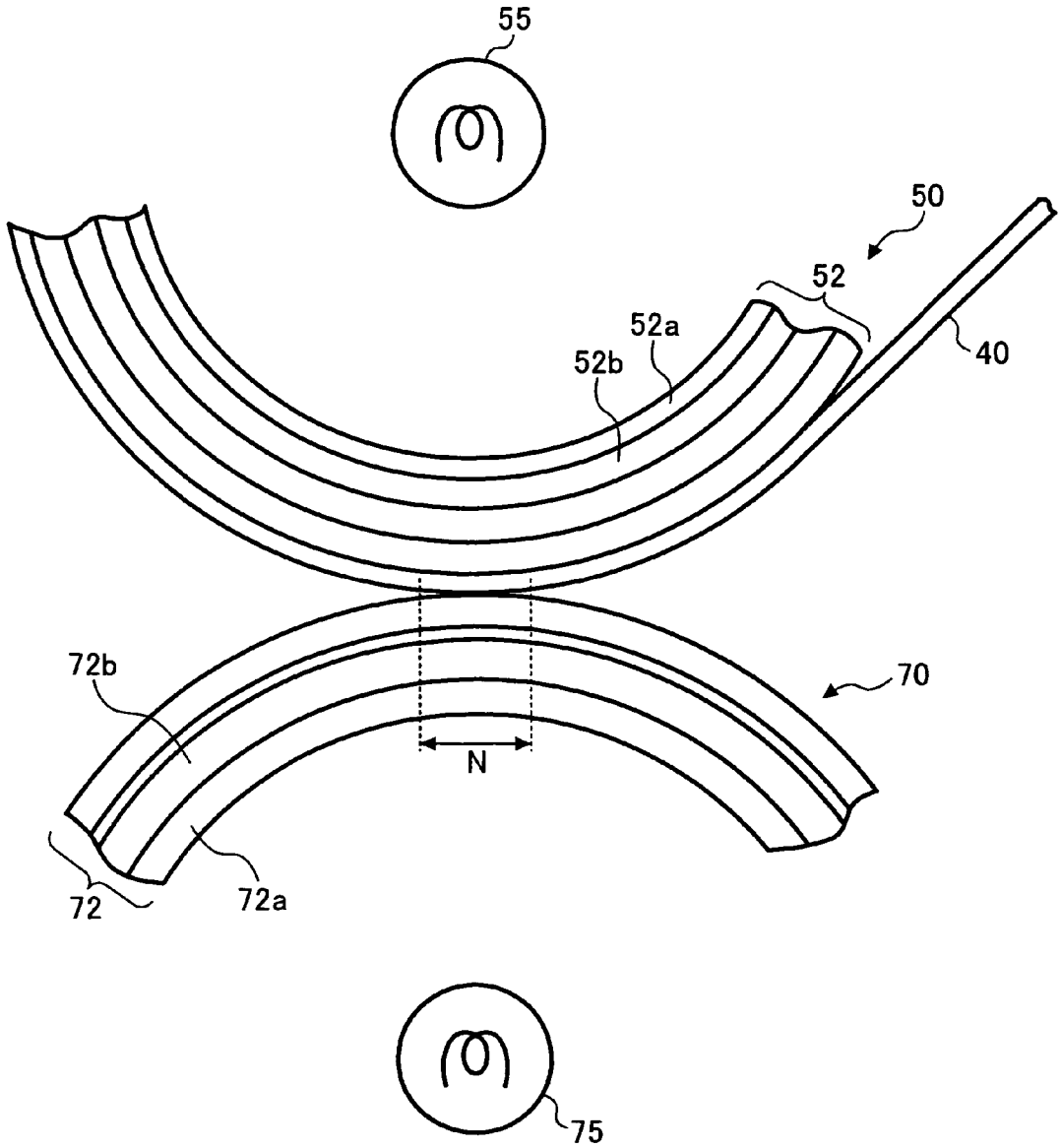
FIG. 3 is an enlarged section showing essential part of the fixing device.

More specifically, as shown in FIG. 3, if the fixing belt 40, warmed up to the preselected temperature at the time of start-up of the apparatus, is caused to stop turning, the fixing roller 50 and press roller 70 are respectively heated by the heaters 55 and 75 in zones 52*a* and 72*a* thereof, but not heated in zones 52*b* and 72*b* between the surfaces of the rollers 50 and 70 heated by the fixing belt 40 and the zones 52*a* and 72*a*, respectively. Consequently, if amounts of heat for heating the above zones 52*b* and 72*b* are not fed from the heaters 55 and 75, respectively, then the temperature of the entire fixing roller 50 or that of the entire press roller 70 drops, lowering the temperature of the nip N below the fixable temperature when a paper sheet is passed.

By contrast, if the fixing belt 40, warmed up to the fixable level or reached a ready state, is caused to continuously turn, then it maintains the surfaces of the fixing roller 50 and press roller 70 at a preselected temperature. Even when the paper sheet P is passed through the nip N between the fixing roller 50 and the press roller 70 in the above condition, the temperature at the nip N can be maintained by the heat of the heaters 65 and 66 because the thermal capacity of a single paper sheet P and therefore the temperature drop of the nip N is negligible.

Figure 4:
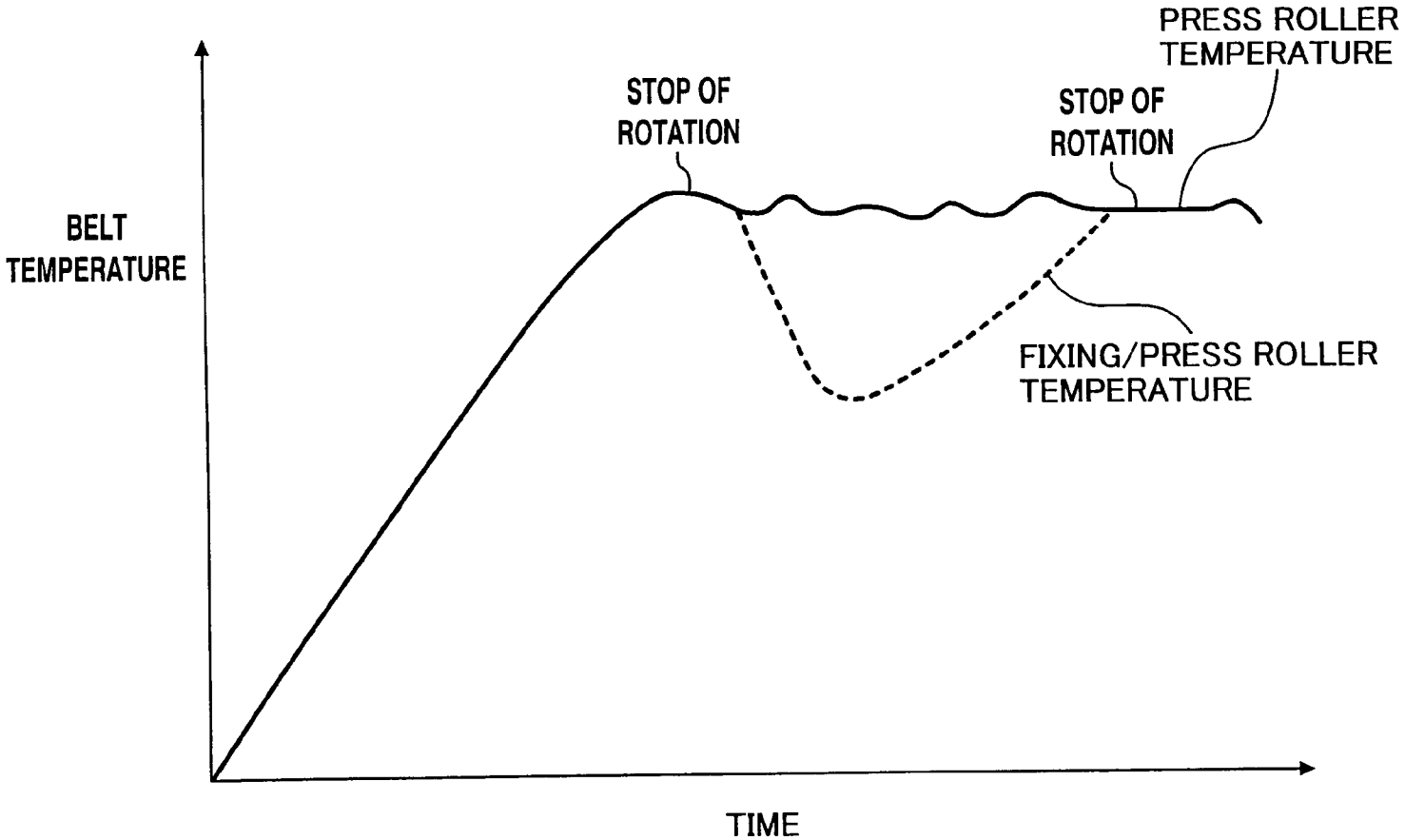
FIGS. 4 through 7 show curves representative of a relation between the temperature of a fixing belt included in the fixing device of the illustrative embodiment and time.

More specifically, as shown in FIG. 4, assume that the temperature of the fixing belt 40 is raised to a preselected warm-up or fixable temperature and then caused to stop rotating. Then, the temperatures of the fixing roller 50 and press roller 70 drop for a moment and again rise to the fixable temperature, as indicated by a dashed curve in FIG. 4. On the other hand, when heat is transferred from the heat roller 60 to the fixing belt 40 that is continuously turning, the temperature of the belt 40 is prevented from dropping, as indicated by a solid curve in FIG. 4.

If a printing cycle is not started just after the warm-up to the ready state, then the fixing device 100 simply idles at a controlled temperature higher than the preselected warm-up temperature or similar preselected sheet-pass temperature. Therefore, the zones 52*b* and 72*b* of the fixing roller 50 and press roller 70, respectively, not fully heated by the fixing belt 40 are rapidly heated by the respective heaters 55 and 57 and fixing belt 40. Consequently, even if the fixing belt 40 is caused to stop turning on the elapse of a preselected period of time, the temperature of the fixing roller 50 and press roller 70 can be raised to the temperature assigned to the ready or stand-by state without being lowered.

Further, in the illustrative embodiment, assume that a print command is input during idling performed in the ready state after the start-up of the apparatus. Then, if the temperatures of the fixing roller 50 and press roller 70 are sharply lowered in the event of transition to the stand-by temperature just after a sheet pass, then the above temperatures are apt to become lower than the fixable temperature at the beginning of feed of the next paper sheet. In light of this, in the illustrative embodiment, idling is continued even after a sheet pass for thereby preventing the temperatures of the fixing roller 50 and press roller 70 from being lowered. For this purpose, the controller 80 sets a total duration of idling beforehand and adds each sheet-pass time thereto. This is successful to reduce a period of time necessary for a warm-up and to prevent the temperature of the fixing belt 40 from dropping just after a start-up at the same time.

Figure 5:
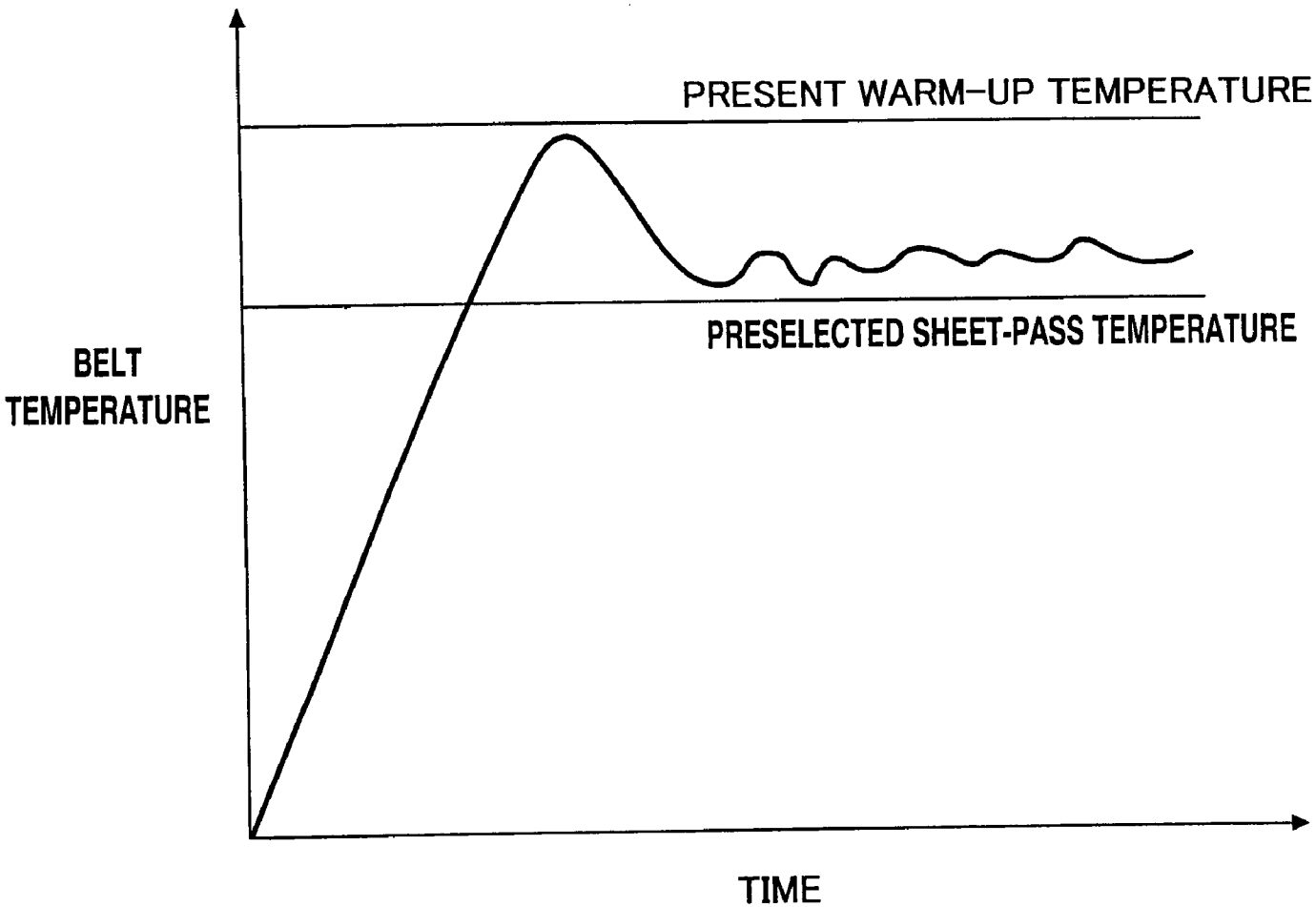

In the illustrative embodiment, the controller 80 does not maintain any one of the heaters turned on for a long period of time by controlling the temperature during idling above a warm-up control temperature or similar sheet-path temperature set beforehand inclusive. Therefore, as shown in FIG. 5, the controller 80 is capable of smoothly controlling the temperature just after the elevation to the warm-up temperature. Also, because the other units of the image forming apparatus are not operating, it is possible to turn on the heaters 55 and 75 of the fixing roller 50 and press roller 70, respectively, with limited power and to stop the idling in a short period of time.

Figure 6:
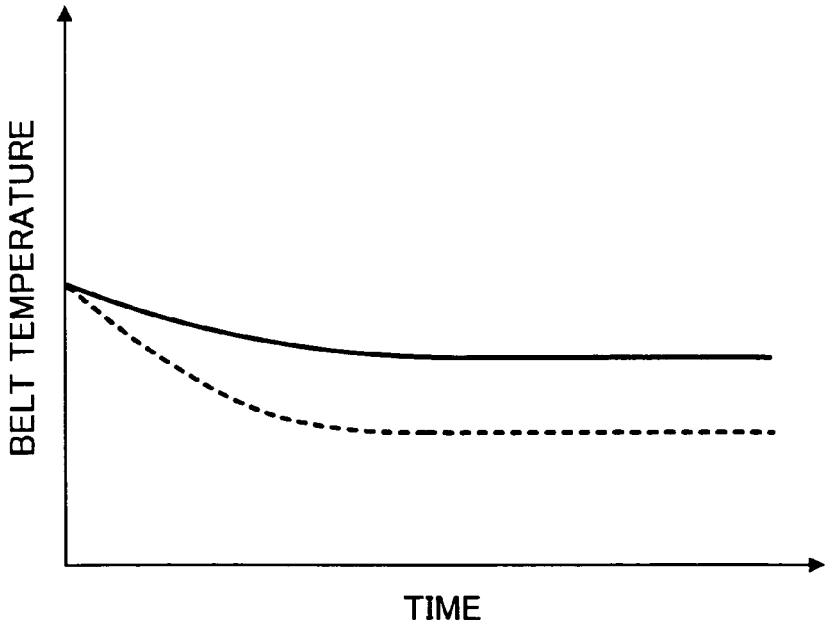

In the illustrative embodiment, because the duration of idling is extended, the heaters 55 and 75 of the fixing roller 50 and press roller 70, respectively, each should only output an amount of heat sufficient to maintain the temperature in the stand-by or ready state. This allows power thus saved to be fed to the heaters 65 and 66 of the heat roller 60 for thereby rapidly heating the fixing belt 40. More specifically, as shown in FIG. 6, for given conditions, the fixing belt 40 can be maintained at a higher temperature when preselected power is applied to the heaters 65 and 66 (solid curve) than when the same power is applied to the heaters 55 and 75 (dashed curve).

Figure 7:
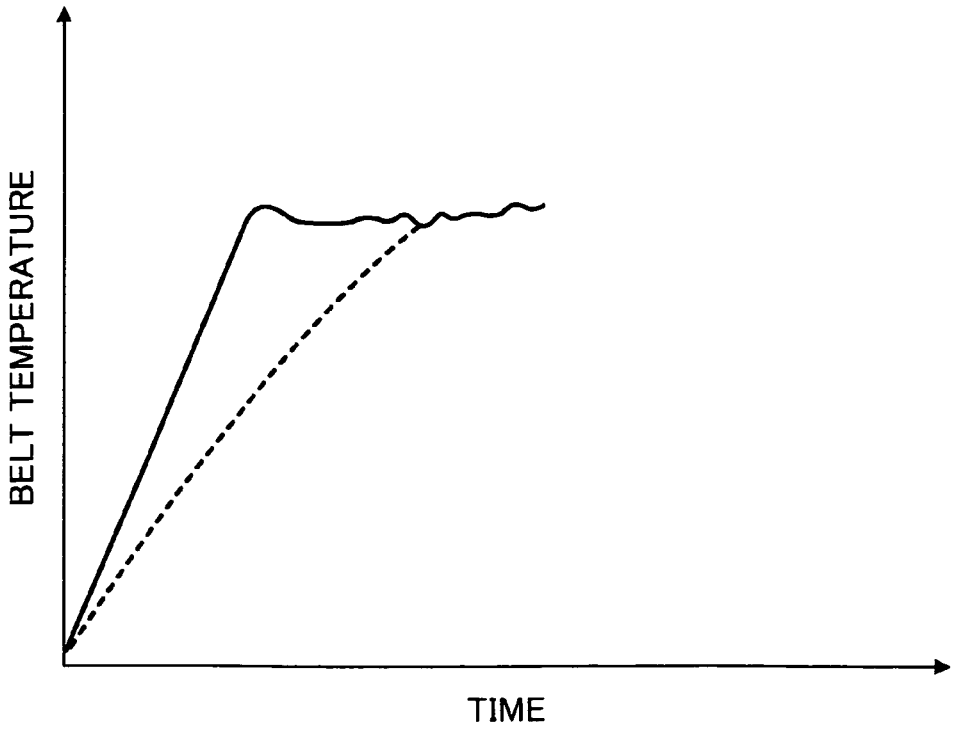

In the illustrative embodiment, the heat roller 60 is bare, i.e., not provided with a cover layer and can therefore efficiently heat the fixing roller 50 via the fixing belt 40. Therefore, idling serves to maintain the temperature elevation characteristic of the fixing belt 40 from the time of the start-up of the apparatus to the beginning of a sheet pass desirable even if the amount of power consumption by the heaters 65 and 66 of the heat roller 60 is reduced. Consequently, for a given amount of power consumption, the fixing belt 40 can be efficiently heated even if greater power is applied to the heaters 65 and 66 than to the heaters 55 and 75. FIG. 7 compares, for a given total amount of power selected beforehand, a case wherein great power is applied to the heaters 65 and 66 of the heat roller 60 (solid line) and a case wherein greater power is applied to the heaters 55 and 75 of the fixing roller 50 and press roller 70, respectively, (dashed line). As shown, the case indicated by the solid line allows the temperature of the fixing belt 40 to rise more sharply than the case indicated by the dashed line.

Figure 8A:
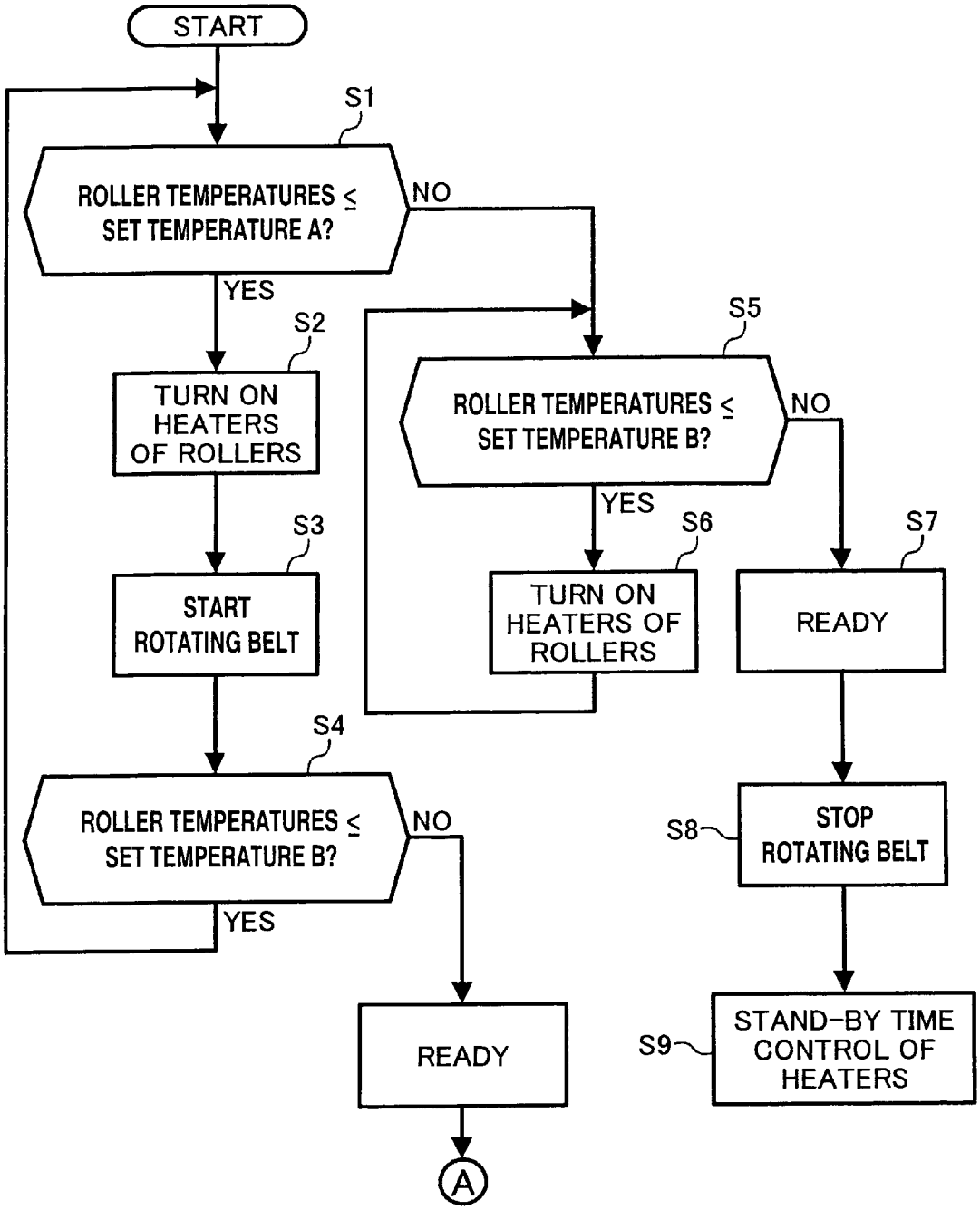
FIGS. 8A and 8B are flowcharts demonstrating a specific operation of the illustrative embodiment.

A specific operation of the controller 80 included in the illustrative embodiment will be described with reference to FIGS. 8A and 8B. As shown in FIG. 8A, after the start of warm-up of the fixing device 100, the controller 80 determines whether or not the temperatures of the rollers 50, 60 and 70 all are lower than a set temperature A inclusive (step S1). The set temperature A is used to determine whether or not the rollers are rotated at the time of warm-up. If the answer of the step S1 is positive (Yes), meaning that the temperatures of the rollers 50, 60 and 70 are lower than the set temperature A inclusive, then the controller 80 turns on the heaters 55, 65 and 66 and 75 of the rollers 50, 60 and 70, respectively, (step S2) and starts turning the fixing belt 40 (step S3). After the step S3, the controller 80 determines whether or not the rollers 50, 60 and 70 all are lower than a set temperature B representative of the end of warm-up of the rollers inclusive (step S4). If the answer of the step S4 is Yes, then the controller 80 repeats the steps S1 through S4 until the rollers 50, 60 and 70 reach the set temperature B.

On the other hand, if the temperatures of the rollers 50, 60 and 70 are higher than the set temperature A (No, step S1) and lower than the set temperature B (Yes, step S5), then the controller 80 turns on the heaters 55, 65 and 66 and 75 of the rollers 50, 60 and 70, respectively, until the rollers 50, 60 and 70 all reach the set temperature B (step S6). When the temperatures of the rollers 50, 60 and 70 all become higher than the set temperature B (No, step S5), then the controller 80 brings the fixing device 100 into a ready or stand-by state (step S7), causes the fixing belt 40 to stop rotating (step S8), and controls the stand-by time of the heaters 55, 65 and 66 and 75 of the rollers 50, 60 and 70, respectively, (step S9).

If the temperatures of the rollers 50, 60 and 70 are higher than the set temperature B (No, step S4 or No, step S5), the controller 80 establishes the ready state. FIG. 8B shows a procedure to be executed in the ready state. As shown, while controlling the rollers 50, 60 and 70 to the set temperature B (step S11), the controller 80 sums up the durations of rotation effected after establishing the ready state (step S12) and then determines whether or not the total duration of rotation is shorter than a preselected period of time T inclusive (step S13) If the answer of the step S13 is No, meaning that the total duration of rotation is longer than the preselected period of time T, then the controller 80 determines whether or not a print start command is input (step S14). In response to the print start command (Yes, step S14), the controller 80 stops counting the total duration of rotation (step S15), executes sheet-pass control with the rollers 50, 60 and 70 (step S16), ends the sheet-pass control (step S17), and then returns to the step S11.

Figure 8B:
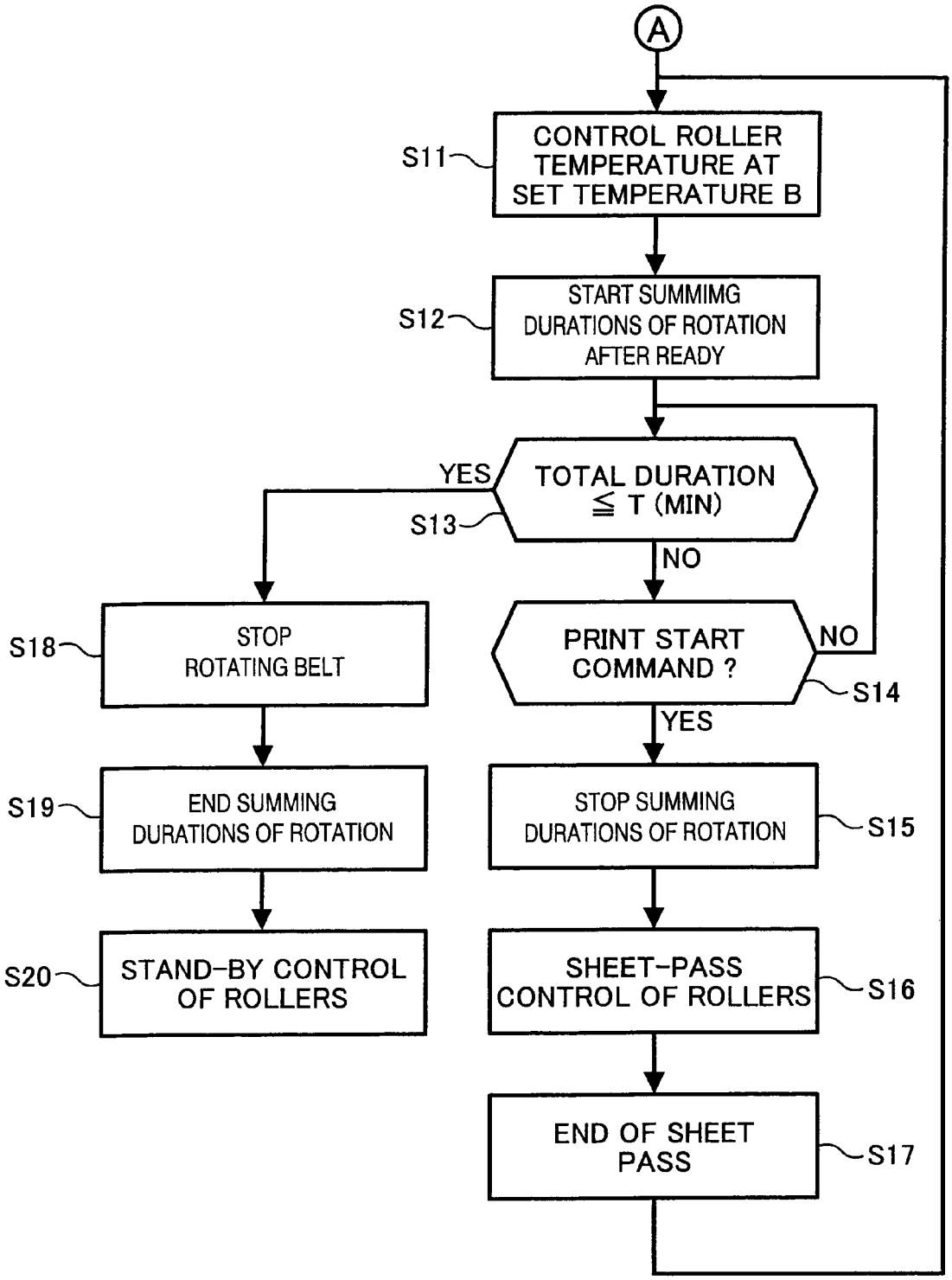

By executing the control stated above with reference to FIGS. 8A and 8B, the illustrative embodiment is capable of reducing the warm-up time of the fixing device 100 after the startup of the apparatus and preventing the temperature of the fixing belt 40 from dropping at the time of beginning of a sheet pass just after the warm-up at the same time. It should be noted that the belt 40 does not have to be idled in the event of a sheet pass effected after the stand-by state, the controller 80 determines whether or not the fixing belt 40 should be turned by using a preselected threshold temperature.

Figure 9:
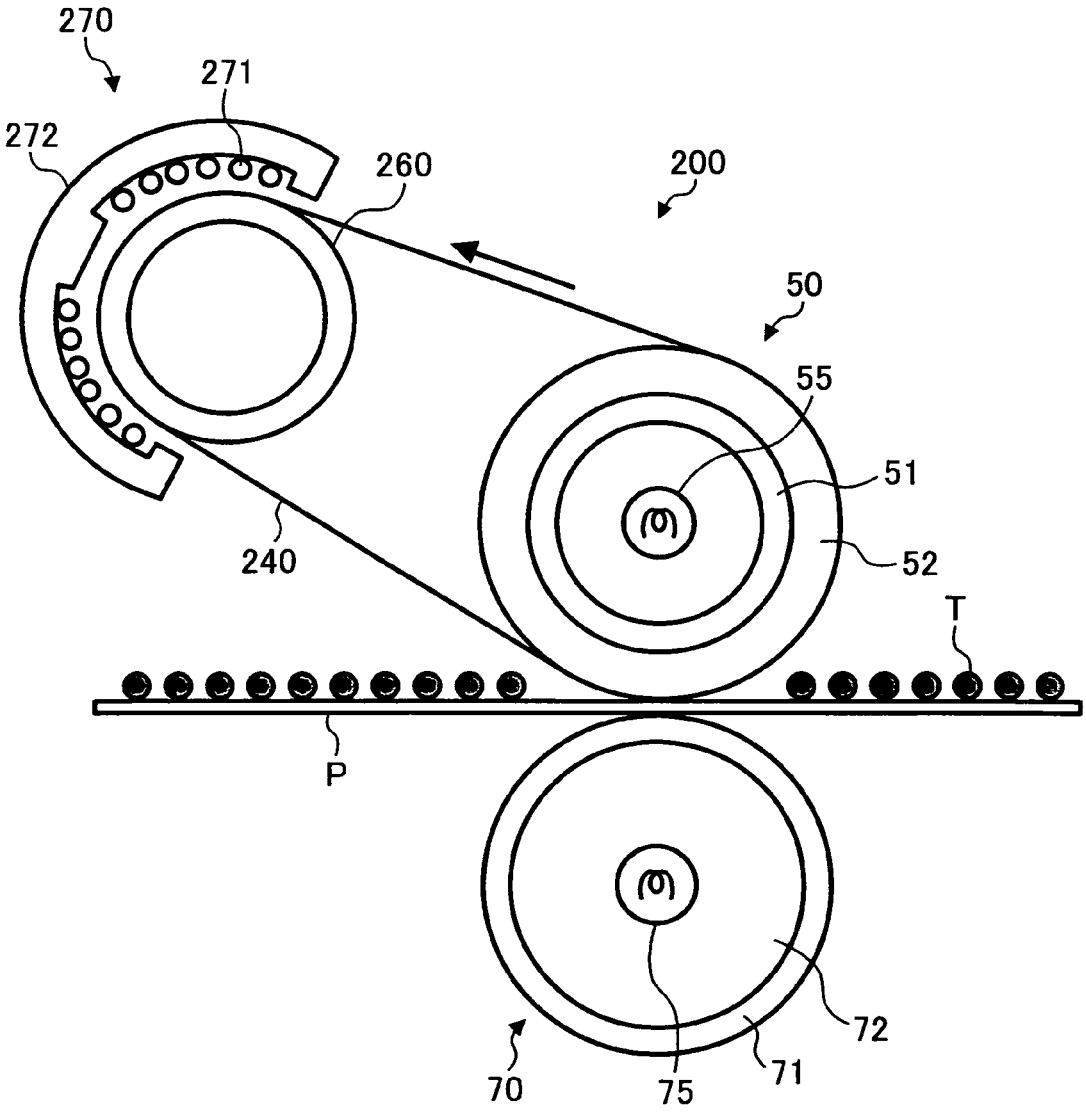
FIG. 9 shows an alternative embodiment of the present invention.

FIG. 9 shows an alternative embodiment of the fixing device in accordance with the present invention. As shown, the fixing device, generally designated by the reference numeral 200, includes a fixing belt 240 provided with a heat generating layer, not shown, formed of metal. The fixing belt 240 is heated by an electromagnetic induction heating device 270 made up of a coil 271 and a core 272. A high-frequency voltage is applied from a high-frequency current source, not shown, to the coil 271 so as to form a magnetic field, so that a current is induced in the heat generating layer of the fixing belt 240 for thereby heating the fixing belt 240. The illustrative embodiment is capable of heating the fixing belt 240 more efficiently than the previous embodiment.

While the fixing belt 240 of the illustrative embodiment is directly heated, an arrangement may alternatively be made such that a drum 260, formed of iron, nickel or similar metal, generates heat.

Various modifications will become possible for those skilled in the art after receiving the teachings of the present disclosure without departing from the scope thereof.

What is claimed is:

1. A fixing device, comprising:

a fixing rotary body including a first heat source;

a pressing rotary body including a second heat source; and a control device configured to cause, during a time of warm-up of said fixing device and prior to a surface temperature of said fixing rotary body rising to a preselected warm-up temperature, said fixing rotary body to rotate while causing at least one of said first heat source and said second heat source to generate heat, to allow, after the surface temperature of said fixing rotary body has risen to the preselected warm-up temperature, a sheet pass or a printing to be executed, and to cause said fixing rotary body to rotate for a preselected period of time, while said sheet pass or said printing is not executed, after the surface temperature of said fixing rotary body has risen to the preselected warm-up temperature, wherein the rotation of said fixing rotary body is continued while said sheet pass or said printing is not executed, when the surface temperature of said fixing rotary body has risen to the preselected warm-up temperature.

2. The fixing device as claimed in claim 1, wherein, when said sheet pass is executed, said control device extends the preselected period of time by a duration of said sheet pass.

3. A fixing device, comprising:

a fixing roller;

a press roller;

a heat roller including a heat source;

a fixing belt passed over said fixing roller and said heat roller, wherein at least one of said fixing roller and said press roller includes a heat source; and a control device configured to cause, during a time of warm-up of said fixing device and prior to a surface temperature of said fixing belt rising to a preselected warm-up temperature, said fixing belt to turn while causing at least one of the heat sources included in the rollers to generate heat, to allow, after the surface temperature of said fixing belt has risen to the preselected warm-up temperature, a sheet pass or a printing to be executed, and to cause said fixing belt to turn for a preselected period of time, while said sheet pass or said printing is not executed, after the surface temperature of said fixing belt has risen to the preselected warm-up temperature, wherein the turning of said fixing belt is continued while said sheet pass or said printing is not executed, when the surface temperature of said fixing belt has risen to the preselected warm-up temperature.

4. The fixing device as claimed in claim 3, wherein, after the surface temperature of said fixing belt has risen to the preselected warm-up temperature and said sheet pass or said printing has been allowed, when said sheet pass occurs while said fixing belt is turned for the preselected period of time, said control device causes said fixing belt to turn by adding, after said sheet pass, a duration of said sheet pass to said preselected period of time.

5. The fixing device as claimed in claim 3, wherein when said fixing belt is turned for the preselected period of time, said control device causes said fixing belt to turn while at least one of the heat sources of the rollers generates heat, thereby raising the surface temperature of said fixing belt above a preselected sheet-pass temperature.

6. The fixing device as claimed in claim 3, wherein each of said fixing roller and said press roller includes a heat source, one of the heat sources of said fixing roller and said press roller having a greater thermal capacity than the other, and the one of the heat sources generates a smaller amount of heat than said heat source of said heat roller.

7. The fixing device as claimed in claim 3, wherein said fixing roller, said press roller, and said heat roller each comprise a metallic core accommodating a heater and a cover layer covering said metallic core, and a thermal conductivity from the metallic core to the cover layer of said heat roller is greater than a thermal conductivity from the metallic core to the cover layer of each of said fixing roller and said press roller.

8. The fixing device as claimed in claim 6, wherein the cover layer of each of said fixing roller, said press roller, and said heat roller is formed of a rubber that has a surface layer made of a fluorocarbon resin.

9. An image forming apparatus, comprising:

an image forming device configured to form a toner image; and a fixing device configured to fix the toner image, said fixing device including a fixing rotary body including a first heat source, a pressing rotary body including a second heat source, and a control device configured to cause, during a time of warm-up of said fixing device and prior to a surface temperature of said fixing rotary body rising to a warm-up temperature, said fixing rotary body to rotate while causing at least one of said first heat source and said second heat source to generate heat, to allow, after the surface temperature of said fixing rotary body has risen to the warm-up temperature, a sheet pass or a printing to be executed, and to cause said fixing rotary body to rotate for a preselected period of time, while said sheet pass or said printing is not executed, after the surface temperature of said fixing rotary body has risen to the warm-up temperature, wherein the rotation of said fixing rotary body is continued while said sheet pass or said printing is not executed, when the surface temperature of said fixing rotary body has risen to the warm-up temperature.

10. The image forming apparatus as claimed in claim 9, wherein the warm-up temperature is higher than a preselected sheet-pass temperature.

11. An image forming apparatus, comprising:

an image forming device configured to form a toner image; and a fixing device configured to fix said toner image, said fixing device including, a fixing roller, a press roller, a heat roller including a heat source, a fixing belt passed over said fixing roller and said heat roller, wherein at least one of said fixing roller and said press roller includes a heat source, and a control device configured to cause, during a time of warm-up of said fixing device and prior to a surface temperature of said fixing belt rising to a preselected warm-up temperature, said fixing belt to turn while causing at least one of the heat sources included in the rollers to generate heat, to allow, after the surface temperature of said fixing belt has risen to the preselected warm-up temperature, a sheet pass or a printing to be executed, and to cause said fixing belt to turn for a preselected period of time, while said sheet pass or said printing is not executed, after the surface temperature of said fixing belt has risen to the preselected warm-up temperature, wherein the rotation of said fixing belt is continued while said sheet pass or said printing is not executed, when the surface temperature of said fixing belt has risen to the preselected warm-up temperature.

12. The image forming apparatus as claimed in claim 11, wherein the preselected warm-up temperature is higher than a preselected sheet-pass temperature.

13. A method, comprising:

generating heat using at least one of a first heat source included in a fixing rotary body and a second heat source included in a pressing rotary body, during a time of warm-up of a fixing device including said fixing rotary body and said pressing rotary body;

rotating said fixing rotary body during the generating time of warm-up of the fixing device and prior to a surface temperature of said fixing rotary body rising to a preselected warm-up temperature;

allowing a sheet pass or a printing to be executed after the surface temperature of said fixing rotary body has risen to the preselected warm-up temperature; and rotating said fixing rotary body for a preselected time period, while said sheet pass or said printing is not executed during the allowing step, wherein the rotation of said fixing rotary body is continued while said sheet pass or said printing is not executed, when the surface temperature of said fixing rotary body has risen to the preselected warm-up temperature.

14. The method as claimed in claim 13, wherein the preselected warm-up temperature is higher than a preselected sheet-pass temperature.

* * * * *